US007005983B2

(12) United States Patent
Holmes et al.

(10) Patent No.: US 7,005,983 B2
(45) Date of Patent: Feb. 28, 2006

(54) METHODS AND APPARATUS FOR DETECTING REFRIGERATOR DOOR OPENINGS

(75) Inventors: John Steven Holmes, Sellersburg, IN (US); Jerry J. Queen, II, New Albany, IN (US); Rollie Richard Herzog, Louisville, KY (US); Mark Robert Mathews, Lombard, IL (US); Robert Marten Bultman, Smithfield, KY (US)

(73) Assignee: General Electric Company, Schenectady, NY (US)

( * ) Notice: Subject to any disclaimer, the term of this patent is extended or adjusted under 35 U.S.C. 154(b) by 547 days.

(21) Appl. No.: 09/754,592

(22) Filed: Jan. 5, 2001

(65) Prior Publication Data

US 2003/0006126 A1 Jan. 9, 2003

(51) Int. Cl.
*G08B 13/08* (2006.01)

(52) U.S. Cl. ..... 340/545.6; 340/686.1; 49/13

(58) Field of Classification Search ..... 340/545.6, 340/545.1, 658, 686.1, 585; 49/13; 62/129, 62/131, 125
See application file for complete search history.

(56) References Cited

U.S. PATENT DOCUMENTS 3,996,434 A * 12/1976 Griffin ..... 200/61.79
4,241,337 A * 12/1980 Prada ..... 340/547
4,463,348 A * 7/1984 Sidebottom ..... 340/585
4,566,285 A 1/1986 Tershak et al. ..... 62/129
4,691,195 A 9/1987 Sigelman et al. ..... 340/545
4,707,684 A 11/1987 Janke et al. ..... 340/530
4,891,626 A * 1/1990 Neuman ..... 340/547
5,063,372 A 11/1991 Gillett ..... 340/547
5,070,319 A * 12/1991 Scuka ..... 340/388.4
5,142,822 A 9/1992 Beckerman ..... 49/27
5,317,115 A * 5/1994 Forsberg ..... 219/716
5,396,217 A * 3/1995 Proefke et al. ..... 340/426.26
5,887,446 A * 3/1999 Lee ..... 62/441

* cited by examiner

*Primary Examiner*—Phung T. Nguyen
(74) *Attorney, Agent, or Firm*—H. Neil Houser, Esq.; Armstrong Teasdale LLP

(57) ABSTRACT

A detection apparatus for detecting refrigerator door openings is coupled to at least one switch configured to be activated by a door opening. When the door is opened, the switch is activated and inputs a signal to the detection apparatus. The detection apparatus rectifies the signal; and phase-shifts the rectified signal so that it leads or lags the line voltage. The shifted output signal is fed to a processor that detects the opening of the door based upon the shifted signal. Signals output by a plurality of switches that generate a signal when activated mixed using an opto-coupler. Relative impedance of the lead and lag circuits may be adjusted to differentiate a phase shift of one shifted signal relative to another signal. The processor converts a value in degrees of phase shifting of the mixed signal to a time value, and based upon the time value, the processor determines which of the doors is open.

23 Claims, 10 Drawing Sheets

FIG. 3B →

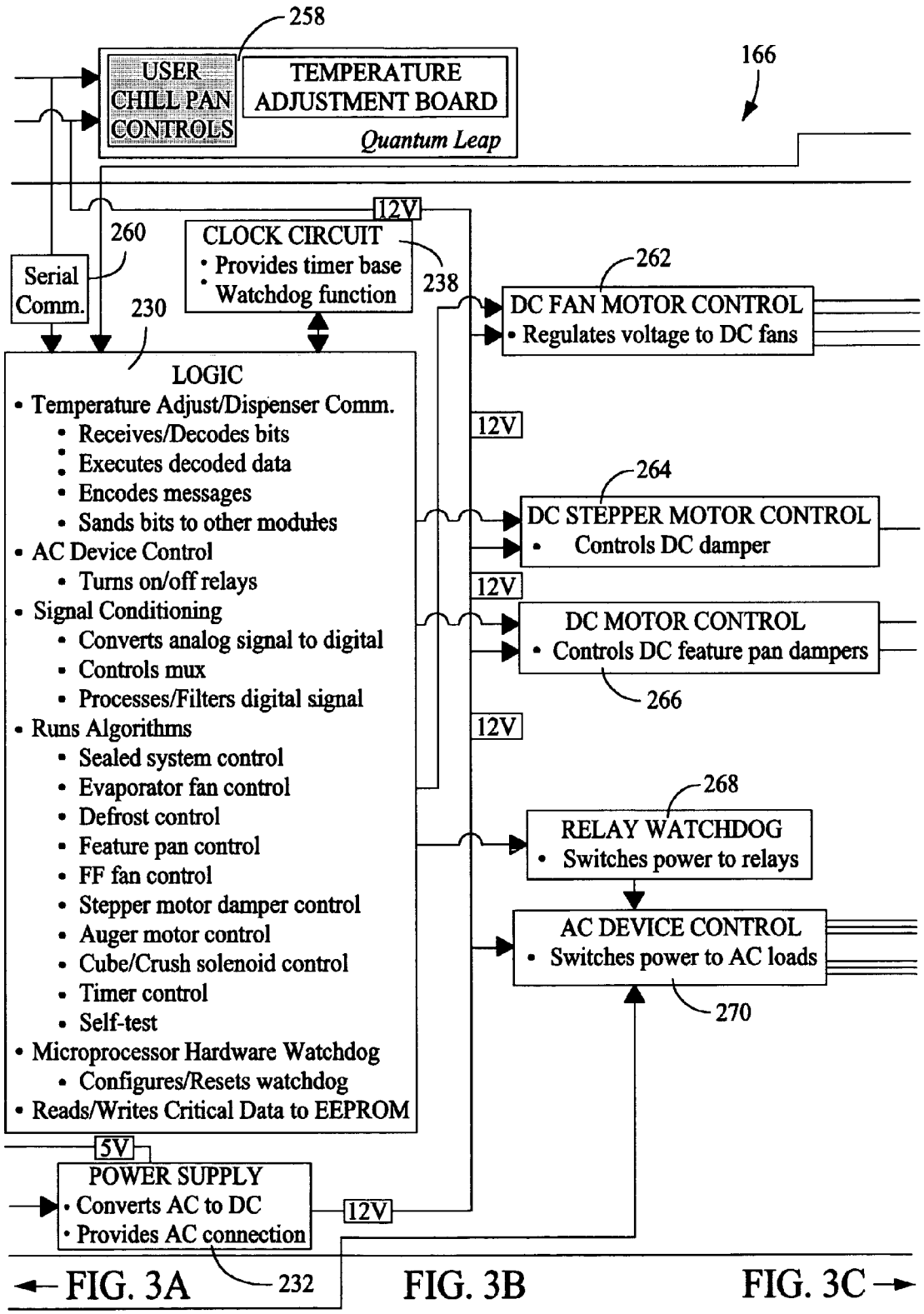
258
USER CHILL PAN CONTROLS
TEMPERATURE ADJUSTMENT BOARD
Quantum Leap
166
12V
CLOCK CIRCUIT
• Provides timer base
• Watchdog function
238
260
Serial Comm.
230
262
DC FAN MOTOR CONTROL
• Regulates voltage to DC fans
LOGIC
• Temperature Adjust/Dispenser Comm.
• Receives/Decodes bits
• Executes decoded data
• Encodes messages
• Sands bits to other modules
• AC Device Control
• Turns on/off relays
• Signal Conditioning
• Converts analog signal to digital
• Controls mux
• Processes/Filters digital signal
• Runs Algorithms
• Sealed system control
• Evaporator fan control
• Defrost control
• Feature pan control
• FF fan control
• Stepper motor damper control
• Auger motor control
• Cube/Crush solenoid control
• Timer control
• Self-test
• Microprocessor Hardware Watchdog
• Configures/Resets watchdog
• Reads/Writes Critical Data to EEPROM
12V
264
DC STEPPER MOTOR CONTROL
• Controls DC damper
12V
DC MOTOR CONTROL
• Controls DC feature pan dampers
266
12V
268
RELAY WATCHDOG
• Switches power to relays
AC DEVICE CONTROL
• Switches power to AC loads
270
5V
POWER SUPPLY
• Converts AC to DC
• Provides AC connection
12V
232
FIG. 3A
FIG. 3B
FIG. 3C

← FIG. 3B

METHODS AND APPARATUS FOR DETECTING REFRIGERATOR DOOR OPENINGS

BACKGROUND OF THE INVENTION

This invention relates generally to refrigerators and, more particularly, to methods and systems for detecting refrigerator door openings.

Known refrigerator typically include a defrost system and one or more cooling system fans for moving air inside the refrigerator. The efficiency of the defrost system and the cooling system often are affected by and depend on the frequency and duration of opening of freezer and/or fresh food compartment doors. For example, a defrost may need to be executed as often when the doors are only infrequently opened, and operation of fans when the doors are open, thereby blowing cold air into the room is undesirable. Therefore, it is desirable for a refrigerator control system to detect the opening and closing of refrigerator and/or freezer compartment doors so that the refrigerator systems may be operated optimally and energy efficiently.

One known method of detecting refrigerator door openings employs low-voltage magnetic (Hall effect) switches in positions redundant to door light switches. Magnetic switches, however, are expensive, and entail additional product assembly. Another known method of detecting refrigerator door openings employs detection circuits on each respective door interior light circuit, thus requiring a separate detection circuit for each door. Separate detection circuits also increase costs.

BRIEF SUMMARY OF THE INVENTION

In an exemplary embodiment, a detection apparatus for detecting refrigerator door openings is coupled to at least one switch configured to be activated by a door opening. When the door is opened, the switch is activated and inputs a signal to the detection apparatus. The detection apparatus rectifies the signal; and phase-shifts the rectified signal so that it leads or lags a reference voltage, such as the line voltage. The shifted output signal is fed to a processor that detects the opening of the door based upon the shifted signal.

More specifically, the phase shift is generated by lead and/or lag circuits to shift voltage of the switch activated signal to lead the line voltage by a lead value between zero degrees and 90 degrees or to lag the line voltage, by a lag value between zero degrees and −90 degrees.

In one embodiment, the apparatus is configured to mix the phase-shifted signals output by a plurality of switches that generate a signal when activated. The signals are supplied to a processor and the mixed signal is isolated using an opto-coupler. Relative impedance of the lead and lag circuits may be adjusted to differentiate a phase shift of one shifted signal relative to another signal/ Because a frequency of the line voltage is known, in one embodiment, the processor converts a value in degrees of phase shifting of the mixed signal to a time value, and based upon the time value, the processor determines which of the doors is open using the time value.

A detection apparatus is therefore provided that allows a single detection circuit to monitor opening of several doors, as well as to identify which of several doors is open. Thus, door openings may be detected in a cost effective manner and used to make energy efficient control decisions.

DETAILED DESCRIPTION OF THE INVENTION

Figure 1:
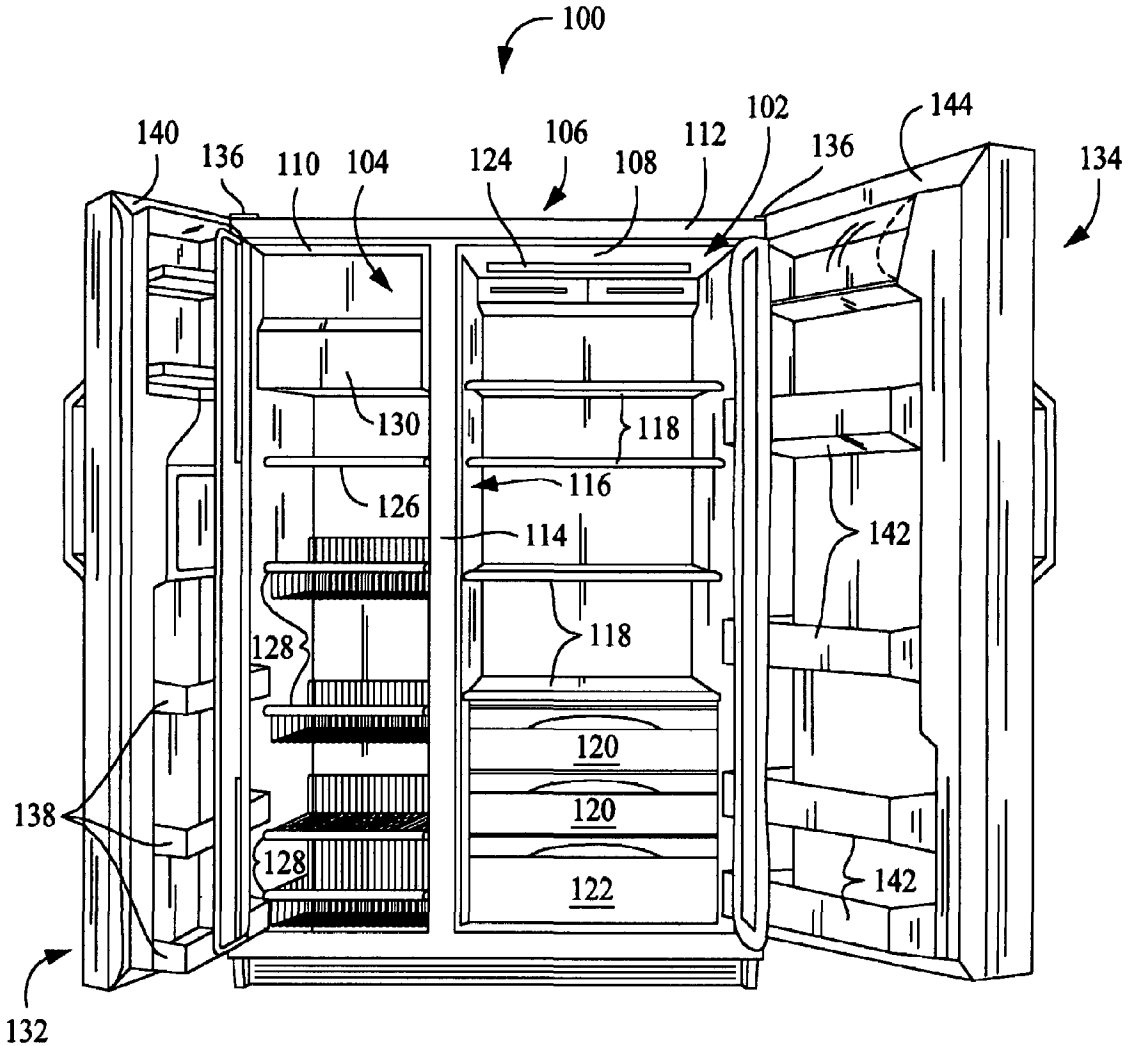
FIG. 1 is a perspective view of a refrigerator.

FIG. 1 illustrates an exemplary side-by-side refrigerator 100 in which the invention may be practiced. It is contemplated, however, that the benefits of the invention accrue to other types of refrigerators and to other appliances where detection of door openings is desirable. Therefore, the description set forth herein is for illustrative purposes only and the invention is not limited to practice with any particular appliance, such as refrigerator 100.

Refrigerator 100 includes a fresh food storage compartment 102 and freezer storage compartment 104. Freezer compartment 104 and fresh food compartment 102 are arranged side-by-side. A side-by-side refrigerator such as refrigerator 100 is commercially available from General Electric Company, Appliance Park, Louisville, Ky. 40225.

Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-syrene based material (commonly referred to as ABS).

The insulation in the space between liners 108, 110 is covered by another strip of suitable resilient material, which also commonly is referred to as a mullion 114. Mullion 114 also preferably is formed of an extruded ABS material. It will be understood that in a refrigerator with separate mullion dividing an unitary liner into a freezer and a fresh food compartment, a front face member of mullion corresponds to mullion 114. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 partly forms a quick chill and thaw system (not shown) selectively controlled, together with other refrigerator features, by a microprocessor (not shown in FIG. 1) according to user preference via manipulation of a control interface 124 mounted in an upper region of fresh food storage compartment 102 and coupled to the microprocessor. Shelves 126 and wire baskets 128 are also provided in freezer compartment 104. In addition, an ice maker 130 may be provided in freezer compartment 104.

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 1, and a closed position (not shown) closing the associated storage compartment. Freezer door 132 includes a plurality of storage shelves 138 and a sealing gasket 140, and fresh food door 134 also includes a plurality of storage shelves 142 and a sealing gasket 144.

In accordance with known refrigerators, refrigerator 100 also includes a machinery compartment (not shown) that at least partially contains components for executing a known vapor compression cycle for cooling air. The components include a compressor (not shown in FIG. 1), a condenser (not shown in FIG. 1), an expansion device (not shown in FIG. 1), and an evaporator (not shown in FIG. 1) connected in series and charged with a refrigerant. The evaporator is a type of heat exchanger which transfers heat from air passing over the evaporator to a refrigerant flowing through the evaporator, thereby causing the refrigerant to vaporize. The cooled air is used to refrigerate one or more refrigerator or freezer compartments via one or more fans (not shown in FIG. 1). Collectively, the vapor compression cycle components in a refrigeration circuit, associated fans, and associated compartments are referred to herein as a sealed system. The construction of the sealed system is well known and therefore not described in detail herein, and the sealed system is operable to force cold air through the refrigerator.

Figure 2:
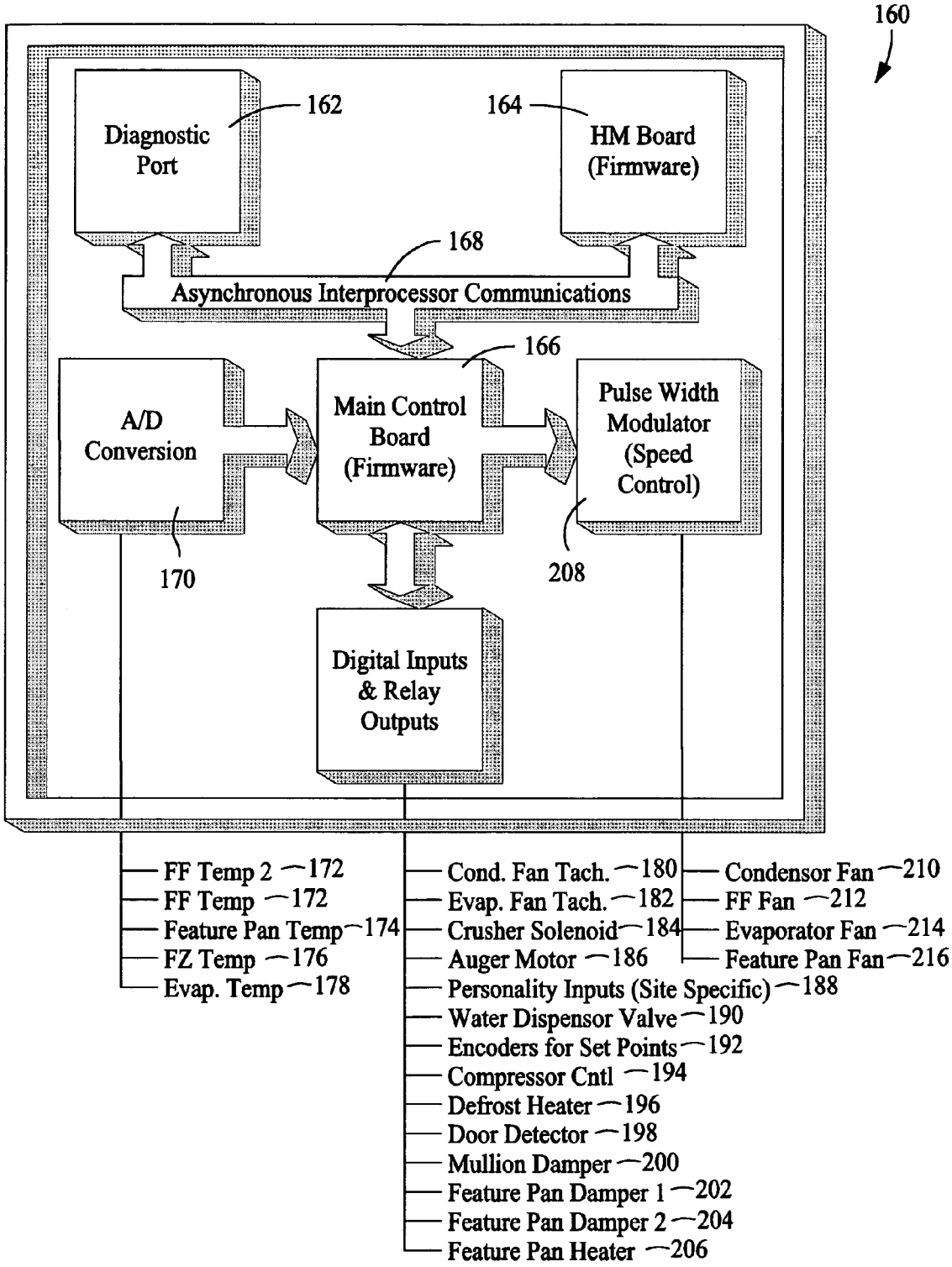
FIG. 2 is a block diagram of a refrigerator controller in accordance with one embodiment of the present invention.

FIG. 2 illustrates a controller 160 in accordance with one embodiment of the present invention. Controller 160 can be used, for example, in refrigerators, freezers and combinations thereof, such as, for example side-by-side refrigerator 100 (shown in FIG. 1).

Controller 160 includes a diagnostic port 162 and a human machine interface (HMI) board 164 coupled to a main control board 166 by an asynchronous interprocessor communications bus 168. An analog to digital converter ("A/D converter") 170 is coupled to main control board 166. AID converter 170 converts analog signals from a plurality of sensors including one or more fresh food compartment temperature sensors 172, a quick chill/thaw feature pan (i.e., pan 122 shown in FIG. 1) temperature sensors 174, freezer temperature sensors 176, external temperature sensors (not shown in FIG. 2), and evaporator temperature sensors 178 into digital signals for processing by main control board 166.

In an alternative embodiment (not shown), A/D converter 170 digitizes other input functions (not shown), such as a power supply current and voltage, brownout detection, compressor cycle adjustment, analog time and delay inputs (both use based and sensor based) where the analog input is coupled to an auxiliary device (e.g., clock or finger pressure activated switch), analog pressure sensing of the compressor sealed system for diagnostics and power/energy optimization. Further input functions include external communication via IR detectors or sound detectors, HMI display dimming based on ambient light, adjustment of the refrigerator to react to food loading and changing the air flow/pressure accordingly to ensure food load cooling or heating as desired, and altitude adjustment to ensure even food load cooling and enhance pull-down rate of various altitudes by chancing fan speed and varying air flow.

Digital input and relay outputs correspond to, but are not limited to, a condenser fan speed 180, an evaporator fan speed 182, a crusher solenoid 184, an auger motor 186, personality inputs 188, a water dispenser valve 190, encoders 192 for set points, a compressor control 194, a defrost heater 196, a door detector 198, a mullion damper 200, feature pan air handler dampers 202, 204, and a quick chill/thaw feature pan heater 206. Main control board 166 also is coupled to a pulse width modulator 208 for controlling the operating speed of a condenser fan 210, a fresh food compartment fan 212, an evaporator fan 214, and a quick chill system feature pan fan 216.

Figure 3A:
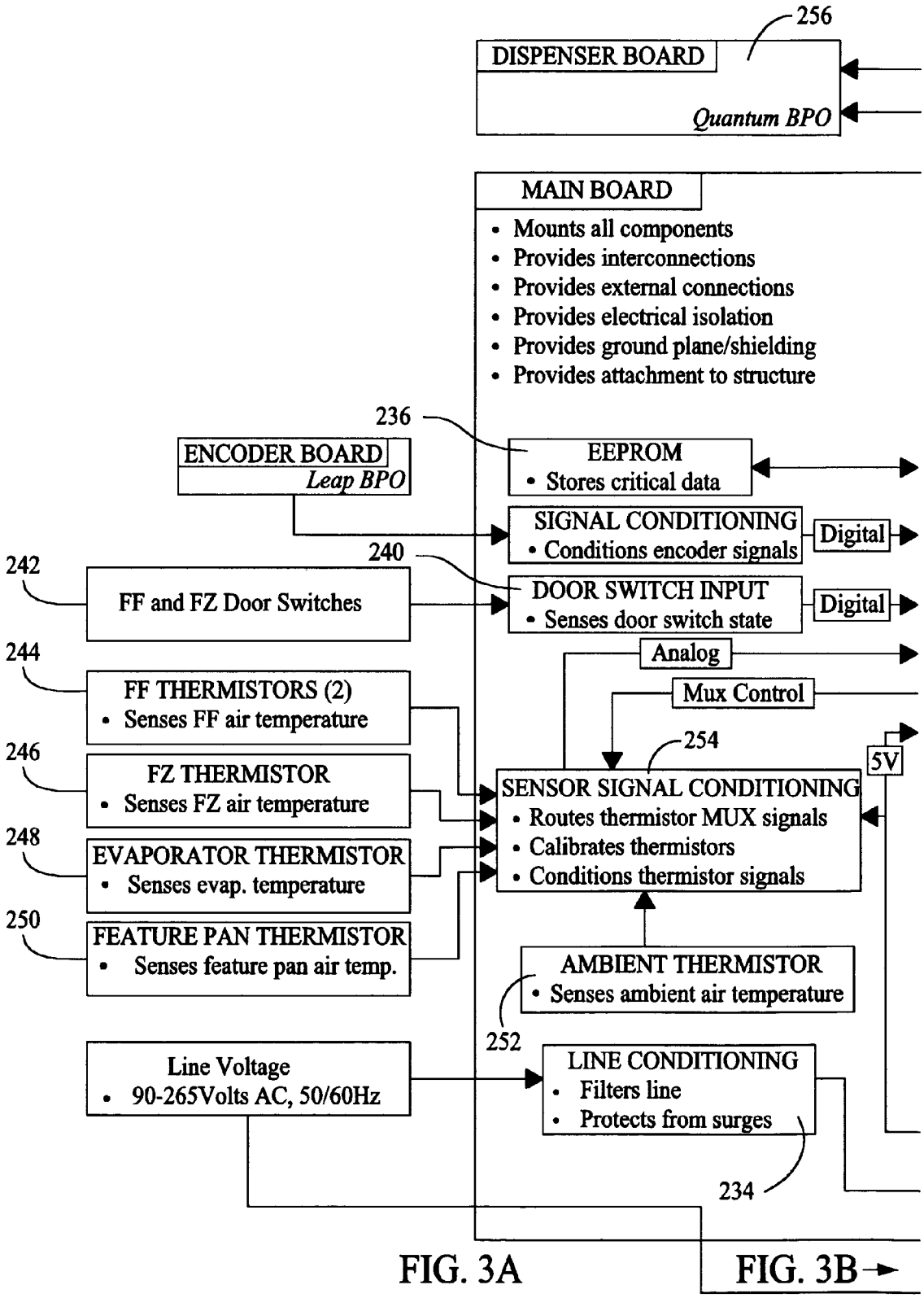
FIG. 3 is a block diagram of the main control board shown in FIG. 2.
Figure 3C:
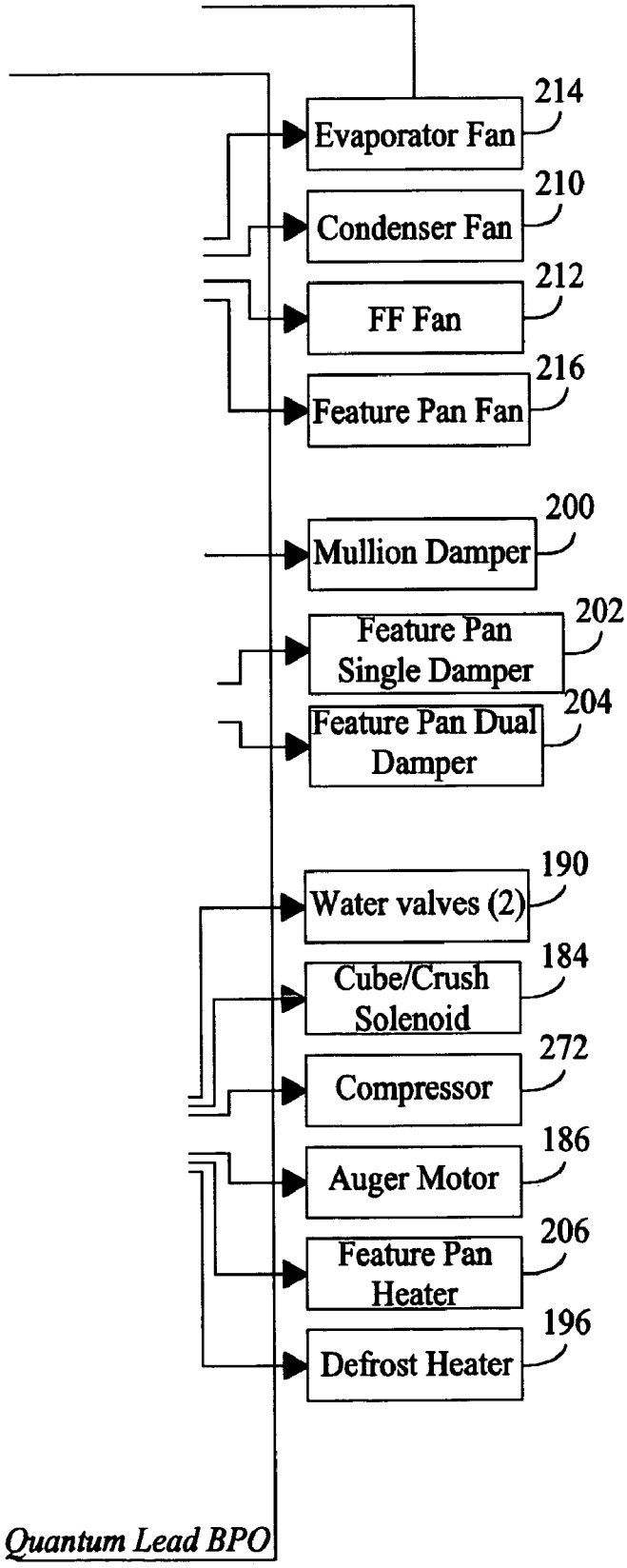
Figure 4:
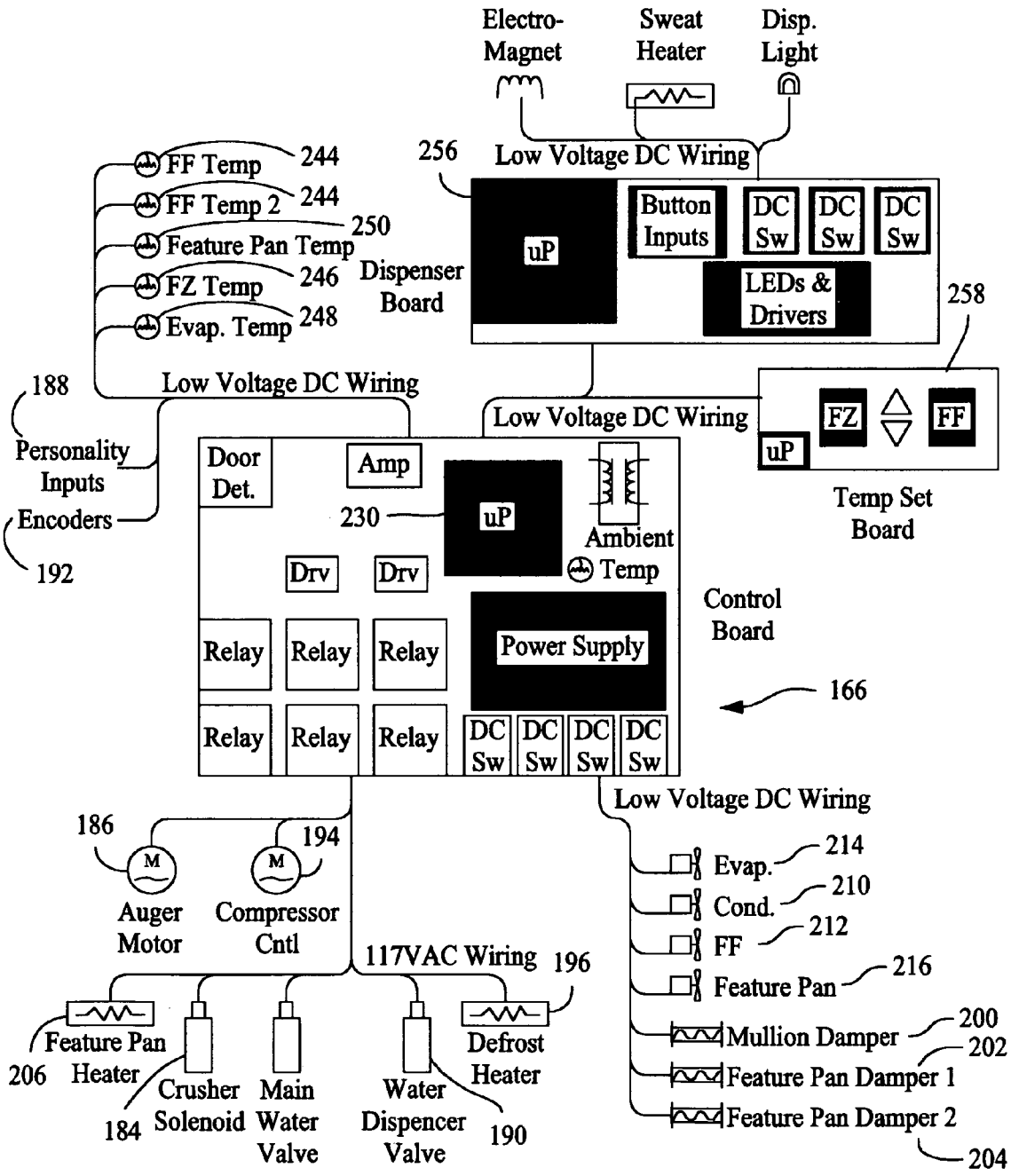
FIG. 4 is a block diagram of the main control board shown in FIG. 2.

FIGS. 3 and 4 are more detailed block diagrams of main control board 166. As shown in FIGS. 3 and 4, main control board 166 includes a processor 230. Processor 230 performs temperature adjustments/dispenser communication, AC device control, signal conditioning, microprocessor hardware watchdog, and EEPROM read/write functions. In addition, processor executes many control algorithms including sealed system control, evaporator fan control, defrost control, feature pan control, fresh food fan control, stepper motor damper control, water valve control, auger motor control, cube/crush solenoid control, timer control, and self-test operations.

Processor 230 is coupled to a power supply 232 which receives an AC power signal from a line conditioning unit 234. Line conditioning unit 234 filters a line voltage which is, for example, a 90–265 Volts AC, 50/60 Hz signal. Processor 230 also is coupled to an EEPROM 236 and a clock circuit 238.

A door switch input sensor 240 is coupled to fresh food and freezer door switches 242, and senses a door switch state. A signal is supplied from door switch input sensor 240 to processor 230, in digital form, indicative of the door switch state. Fresh food thermistors 244, a freezer thermistor 246, at least one evaporator thermistor 248, a feature pan thermistor 250, and an ambient thermistor 252 are coupled to processor 230 via a sensor signal conditioner 254. Conditioner 254 receives a multiplex control signal from processor 230 and provides analog signals to processor 230 representative of the respective sensed temperatures. Processor 230 also is coupled to a dispenser board 256 and a temperature adjustment board 258 via a serial communications link 260. Conditioner 254 also calibrates the above-described thermistors 244, 246, 248, 250, and 252.

Processor 230 provides control outputs to a DC fan motor control 262, a DC stepper motor control 264, a DC motor control 266, and a relay watchdog 268. Watchdog 268 is coupled to an AC device controller 270 that provides power to AC loads, such as to water valve 190, cube/crush solenoid 184, a compressor 272, auger motor 186, a feature pan heater 206, and defrost heater 196. DC fan motor control 262 is coupled to evaporator fan 214, condenser fan 210, fresh food fan 212, and feature pan fan 216. DC stepper motor control 264 is coupled to mullion damper 200, and DC motor control 266 is coupled to one or more sealed system dampers.

Processor logic is used to make control decisions based at least in part on freezer door state and fresh food door state, i.e., frequency and duration of door opening and closing. Specifically, controller 160 activates one or more of loads in response to freezer door state and fresh food door state, including but not limited to operation of fresh food fan 212, evaporator fan 214, condenser fan 210, a compressor relay, a defrost relay, and mullion damper stepper motor 264.

Figure 5:
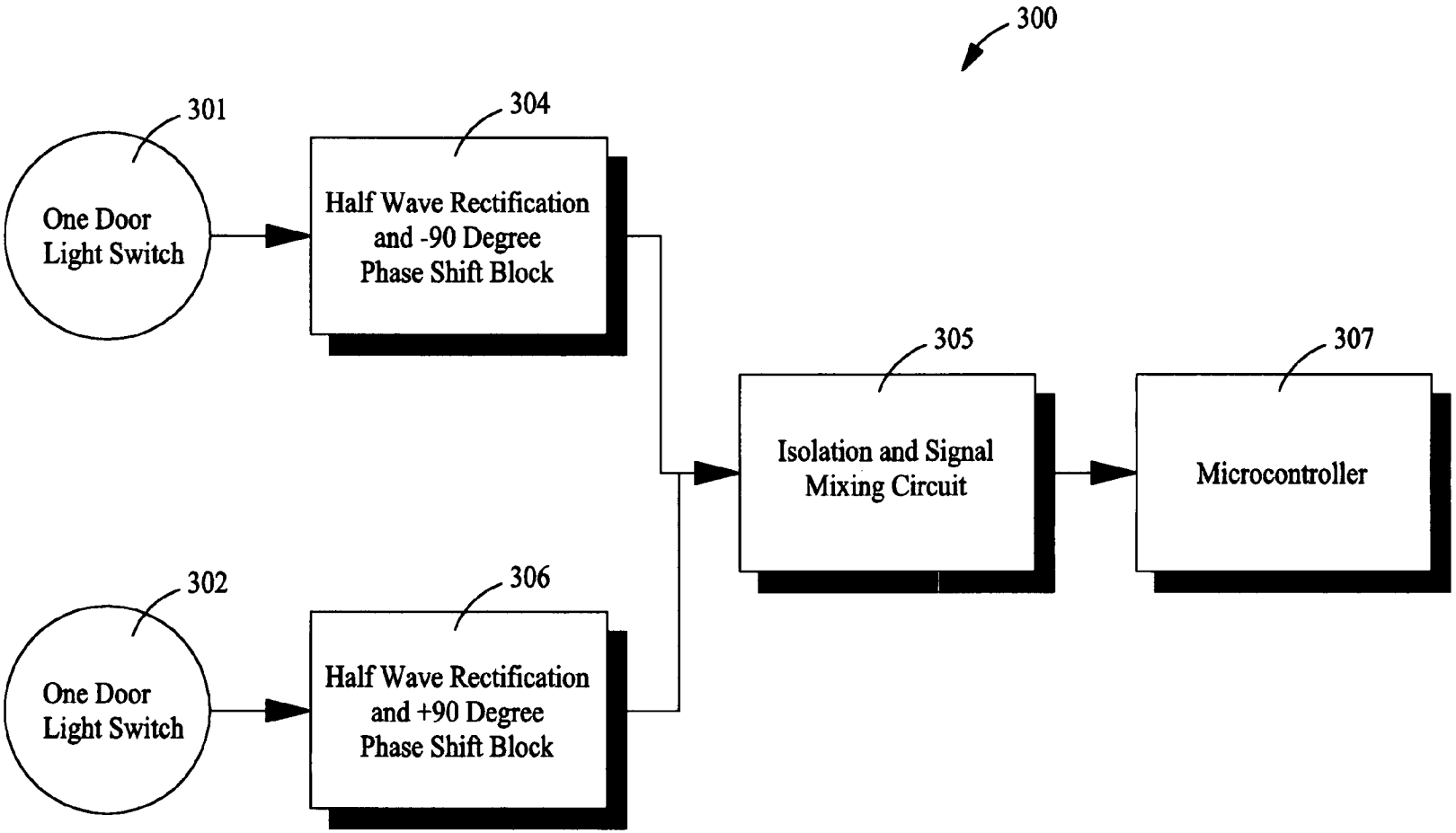
FIG. 5 is a block diagram of an open door detection system.

FIG. 5 illustrates, in block diagram form, an exemplary door detection apparatus 300 that determines door openings with phase shifting and quadrature phase detection of refrigerator interior light signals. Apparatus 300 employs door switches 242 (shown in FIG. 3) and more specifically a first door light switch 301 for freezer compartment door 132 (shown in FIG. 1) and a second light switch 302 for fresh food compartment door 134 (shown in FIG. 1). A half wave rectification and phase shift lag circuit 304 is coupled to first door light switch 301, and a half wave rectification and phase shift lead circuit 306 in communication with second door switch 302. An opto-coupler 305 is coupled to phase shift lag circuit 304 and phase shift lead circuit 306 for isolating and mixing respective signals, and a processor 307 is coupled to opto-coupler 305. As described operationally below, detection apparatus 300 achieves electrically isolated, quadrature phase detection of opening of refrigerator doors 132, 134.

When either freezer compartment door 132 or fresh food compartment door 134 is opened, the respective first switch 301 or second switch 302 is activated to signal energization of interior lights for the respective refrigeration compartment. Signals from respective switches 301, 302 are rectified and phase shifted via circuits 304, 306, and the phase-shifted signals are fed to opto-coupler 305. A voltage signal input from first switch 301 is output as a signal that is nearly 90° behind of the line voltage whereas a signal input from second switch 302 is output as a voltage signal that is nearly 90° ahead of the line voltage. If switches 301, 302 are active at the same time, a signal is output that covers approximately 180° of the input line signal.

Figure 6:
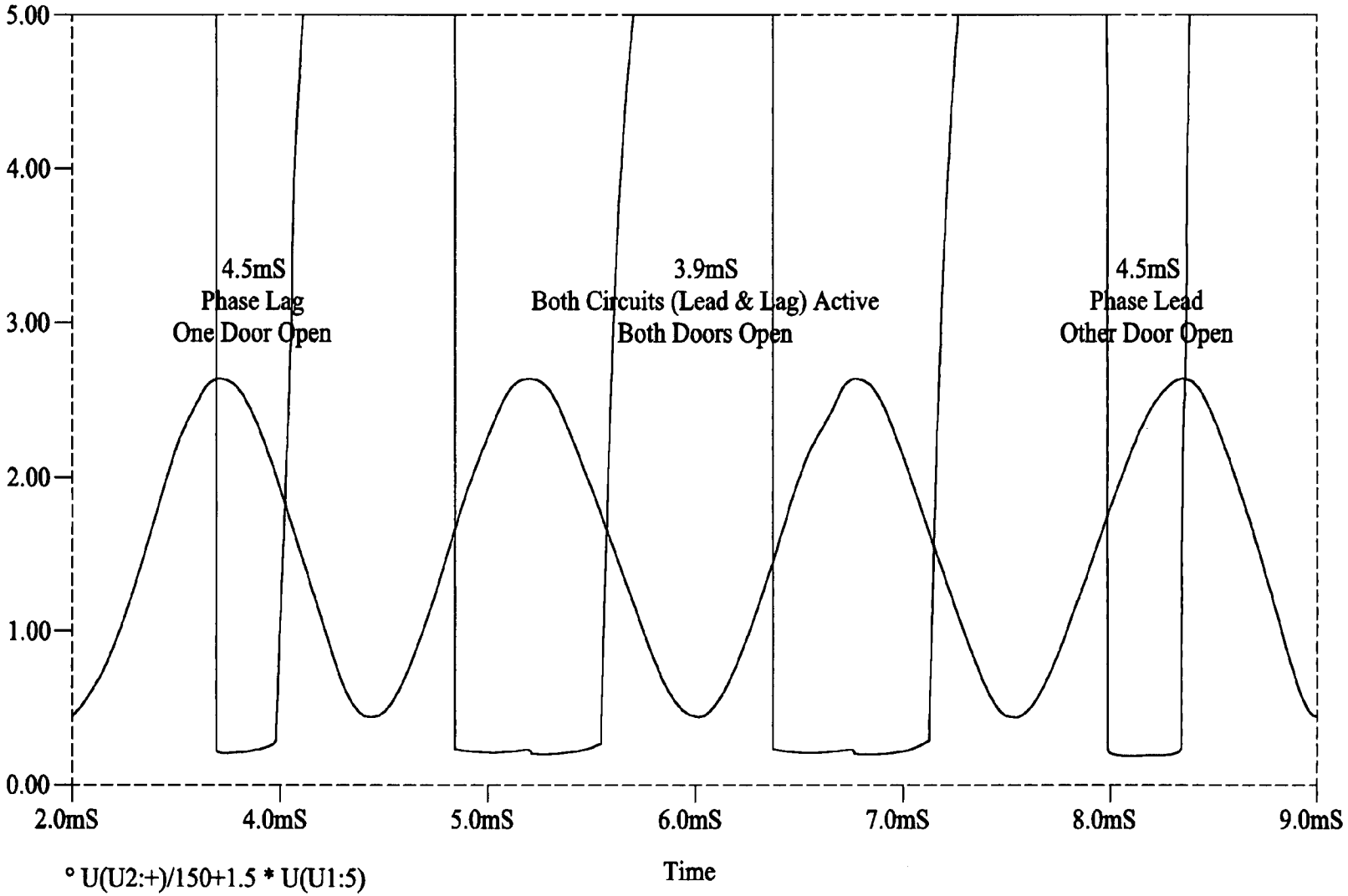
FIG. 6 is an illustration of waveforms produced by the system illustrated in FIG. 2.

FIG. 6 illustrates an exemplary waveform output of apparatus 300 in relation to the line or input signal. By comparing the output of signal of apparatus 300 with the reference line voltage, it may be determined whether one or both of refrigerator doors 132, 134 are open. Those in the art will recognize that these waveforms are produced by lead and lag circuits of equal impedance, and in this particular example, both the lead and lag circuits are tuned to about an 87° phase shift. It is recognized that the relative impedance of the lead and lag circuits can be adjusted to change the phase shift for one or both circuits to facilitate detection of which door has been opened.

Figure 7:
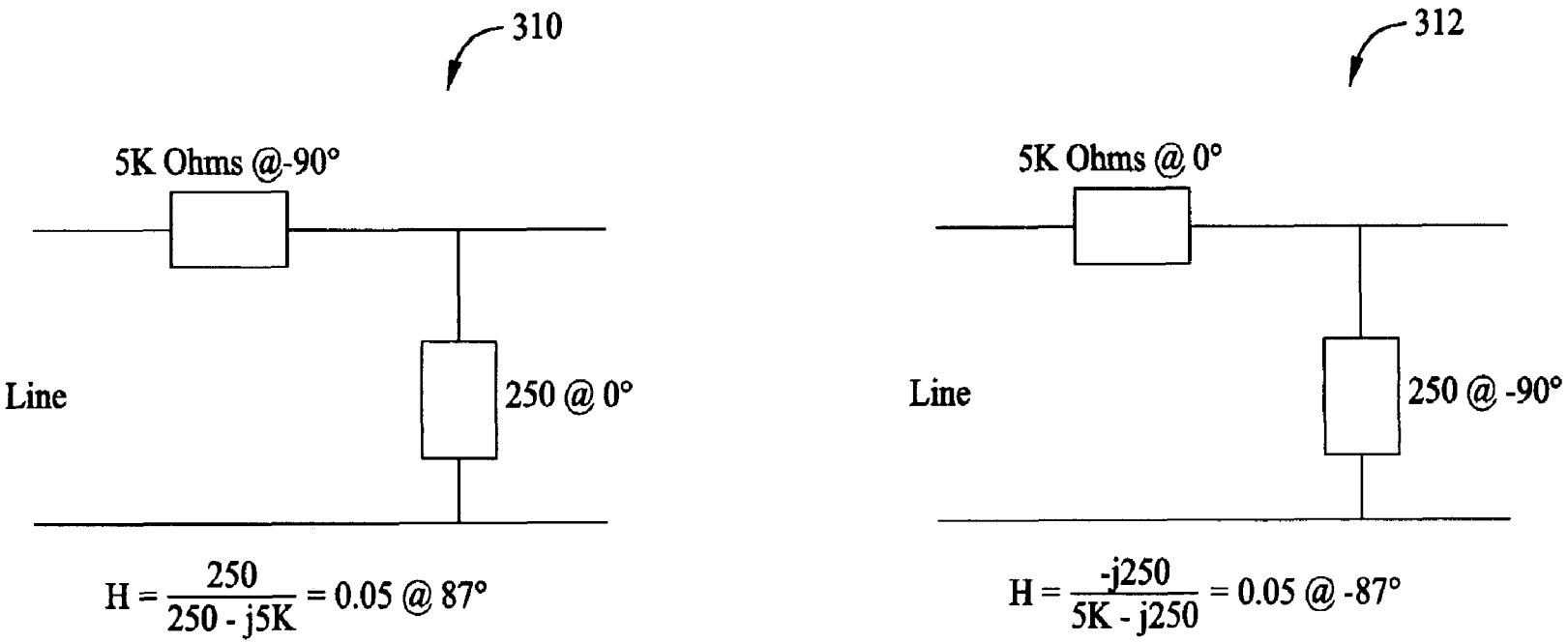
FIG. 7 is an illustration of lead and lag circuits.

FIG. 7 illustrates exemplary phase lead and lag circuits 310, 312. It is evident from these circuits that the phase lead may be adjusted from nearly 0 to 90°. Similarly, the lag may be adjusted from 0 to nearly −90 degrees. Since the line frequency is a fixed 50 or 60 Hertz, the degrees of lead or lag may be converted directly to a time value. Processor 230 (shown in FIG. 3) then uses the time values to determine which door is open.

Figure 8:
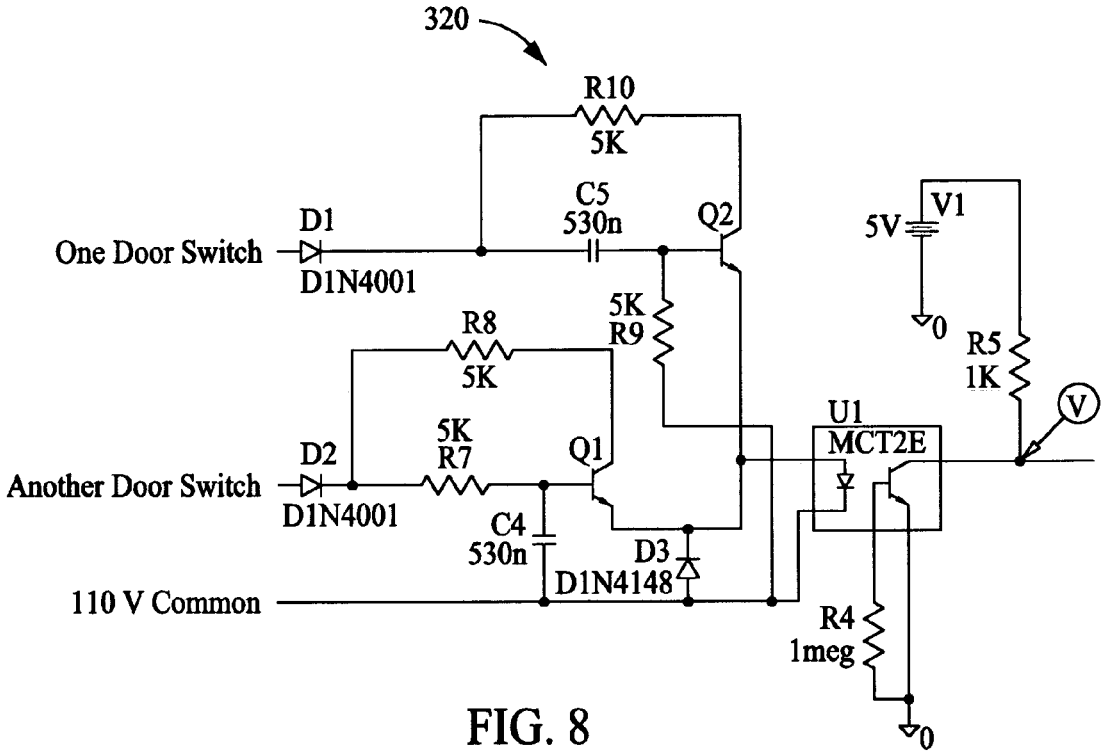
FIG. 8 is an illustration of a circuit for phase shift—quadrature detection.
Figure 9:
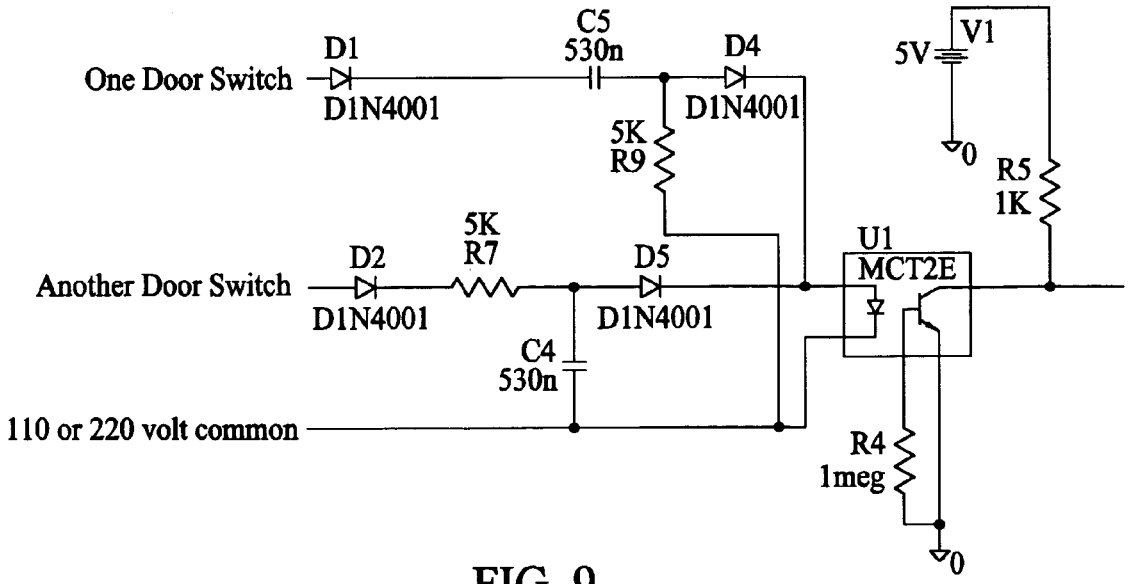
FIG. 9 is an alternative embodiment of the circuit shown in FIG. 8.

One exemplary circuit 320 for achieving the above described open door detection is illustrated schematically in FIG. 8. In this circuit, C5 and R9 provide a phase lead whereas C4 and R7 provide a phase lag. Q1, Q2 and U1 provide the mixing and level shifting functions. In alternative embodiments, a zero degree phase shift on one line and 90 degree phase shift (lead or lag) on the other is used. In a further embodiment, a single component for the mixing/level shifting function is used, as illustrated in FIG. 9.

A detection apparatus is therefore provided that allows a single detection circuit to monitor opening of several doors, as well as to identify which of several doors is open. Thus, door openings may be detected in a cost effective manner and used to make energy efficient control decisions.

While the invention has been described in terms of various specific embodiments, those skilled in the art will recognize that the invention can be practiced with modification within the spirit and scope of the claims.

What is claimed is:

1. A method for detecting an open door of a refrigerator, the refrigerator including at least one door including a first door, at least one switch including a first switch configured to be activated by opening of said first door, and at least one detection circuit including at least one phase shift circuit coupled to an opto-coupler and a processor, said method comprising the steps of:

receiving a signal from said first switch when said first switch is activated;

phase-shifting the signal;

feeding the phase-shifted signal to the opto-coupler;

isolating the phase-shifted signal in the opto-coupler;

monitoring an output signal from the processor; and comparing said output signal with a line signal to determine whether the first door is open.

2. A method in accordance with claim 1 wherein said step of phase-shifting the signal comprises the steps of:

rectifying the signal; and phase-shifting the rectified signal.

3. A method in accordance with claim 2 wherein said step of rectifying the signal comprises the step of half-wave rectifying the signal.

4. A method in accordance with claim 2 wherein said step of phase-shifting the rectified signal comprises the step of producing a shifted voltage leading a line voltage.

5. A method in accordance with claim 4 wherein the shifted voltage leads the line voltage by a lead value between zero degrees and 90 degrees.

6. A method in accordance with claim 2 wherein said step of phase-shifting the rectified signal comprises the step of producing a shifted voltage lagging a line voltage.

7. A method in accordance with claim 6 wherein the shifted voltage lags the line voltage by a lag value between zero degrees and −90 degrees.

8. A method in accordance with claim 1 wherein the refrigerator includes a plurality of doors included within the at least one door and includes corresponding switches included within the at least one switch, said method further comprising the steps of:

receiving a plurality of signals from the switches when the switches are activated;

phase-shifting the-signals from the switches;

mixing the phase-shifted signals for the switches; and supplying the mixed signal to a processor.

9. A method in accordance with claim 8 wherein said step of mixing the phase-shifted signals comprises mixing the phase-shifted signals using an opto-coupler.

10. A method in accordance with claim 8 wherein further comprising the steps of:

converting a value in degrees of phase shifting of the mixed signal to a time value; and determining which of the doors is open using the time value.

11. A method in accordance with claim 8 further comprising the step of shifting a phase of a signal output by one activated switch to a degree different in magnitude from a degree of shift of another switch signal output.

12. A method in accordance with claim 8 wherein said steps of phase shifting the signals from the switches and mixing the phase-shifted signals are performed using a single component.

13. An apparatus for detecting refrigerator door openings, the refrigerator including at least one switch configured to be activated by a door opening, said apparatus configured to:

phase-shift a signal output by an activated switch;

isolate the phase-shifted signal using an opto-coupler;

determine whether a door is open using the shifted signal; and provide the shifted signal to a microcontroller.

14. An apparatus in accordance with claim 13 wherein said apparatus is further configured to rectify the signal; and phase-shift the rectified signal.

15. An apparatus in accordance with claim 14 further configured to half-wave rectify the signal.

16. An apparatus in accordance with claim 14 further configured to produce a shifted voltage leading a line voltage.

17. An apparatus in accordance with claim 16 further configured to produce a shifted voltage leading the line voltage by a lead value between zero degrees and 90 degrees.

18. An apparatus in accordance with claim 14 further configured to produce a shifted voltage lagging a line voltage.

19. An apparatus in accordance with claim 18 further configured to produce a shifted voltage lagging the line voltage by a lag value between zero degrees and −90 degrees.

20. An apparatus for detecting refrigerator door openings of a refrigerator, the refrigerator including a plurality of doors and corresponding switches configured to be activated by the refrigerator door openings, said apparatus configured to:

phase-shift signals output by activated switches;

determine whether the doors are open by using the phase-shifted signals;

mix the phase-shifted signals output by the activated switches to generate a mixed signal;

isolate the mixed signals using an opto-coupler; and supply the mixed signal to a processor.

21. An apparatus in accordance with claim 20 further configured to:

convert a value in degrees of phase shifting of the mixed signal to a time value; and determine which of the doors is open using the time value.

22. An apparatus in accordance with claim 20 further configured to shift a phase of a signal output by one activated switch to a degree different in magnitude from a degree of shift of another switch signal output.

23. An apparatus in accordance with claim 20 further comprising a single component configured to phase shift and mix the phase-shifted signals.

* * * * *